US008322414B2

(12) United States Patent
Al-Gouhi et al.

(10) Patent No.: US 8,322,414 B2
(45) Date of Patent: Dec. 4, 2012

(54) SURFACE DETECTION OF FAILED OPEN-HOLE PACKERS USING TUBING WITH EXTERNAL TRACER COATINGS

(75) Inventors: Al-Walid Abdullah Al-Gouhi, Dhahran (SA); Kirk M. Bartko, Dhahran (SA); Drew Hembling, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 176 days.

(21) Appl. No.: 12/800,976

(22) Filed: May 25, 2010

(65) Prior Publication Data

US 2011/0290480 A1 Dec. 1, 2011

(51) Int. Cl.
*E21B 47/10* (2012.01)
*E21B 33/124* (2006.01)

(52) U.S. Cl. ..... 166/250.12; 166/369; 166/387; 166/191

(58) Field of Classification Search ..... 166/250.12, 166/387, 369, 191, 186
See application file for complete search history.

(56) References Cited

U.S. PATENT DOCUMENTS 3,848,124 A 11/1974 Vann
4,008,763 A 2/1977 Lowe, Jr.
5,392,850 A 2/1995 Cornette et al.
5,892,147 A 4/1999 Garnes et al.
6,564,866 B2 5/2003 Clark et al.
6,645,769 B2 11/2003 Tayebi et al.
6,672,385 B2 1/2004 Kilaas et al.
6,896,074 B2 5/2005 Cook et al.
7,100,691 B2 9/2006 Nguyen et al.
7,104,324 B2 9/2006 Wetzel et al.
7,347,260 B2 * 3/2008 Ferguson et al. ..... 166/250.12
2001/0036667 A1 11/2001 Tayebi et al.
2007/0289740 A1 12/2007 Thigpen et al.
2008/0262735 A1 10/2008 Thigpen et al.
2009/0266533 A1 10/2009 Baajiens et al.
2010/0212891 A1 8/2010 Stewart et al.

OTHER PUBLICATIONS

International Search Report and Written Opinion mailed Apr. 23, 2012 by the International Search Authority in International Application No. PCT/US2011/037685 (8 pages).

* cited by examiner

*Primary Examiner* — Nicole Coy
(74) *Attorney, Agent, or Firm* — Abelman, Frayne & Schwab

(57) ABSTRACT

Distinctive and analytically distinguishable water-soluble and oil-soluble tracer compositions are applied as coatings to the exterior surface of one or more lengths of production tubing installed in a horizontal well bore between open-hole packers adjacent one or more inflow control devices, (ICD), whereby water and/or oil contacting one or more of the respective tracer coatings and passing a faulty open-hole packer seal will solubilize the tracer coating(s) and be detectable by appropriate tests on the produced water and/or hydrocarbon fluids at the earth's surface.

18 Claims, 4 Drawing Sheets

SURFACE DETECTION OF FAILED OPEN-HOLE PACKERS USING TUBING WITH EXTERNAL TRACER COATINGS

FIELD OF THE INVENTION

This invention relates to a method used in the completion of horizontal sections of a subterranean hydrocarbon-producing well where no casing is installed, and specifically to the technique in which so-called open-hole packers are used for the purpose of forming compartments in the reservoir rock along the length of the horizontal pipe, or production tubing, that carries the produced hydrocarbon product to the surface. The term "open-hole" refers to the fact that no well casing pipe has been installed in the horizontal section, as it is typically installed in the vertical portion of the well bore.

BACKGROUND OF THE INVENTION

A principal objective of advance well completion is to have flow control over different inflow areas along the horizontal section of the well bore. This flow control is heavily dependent on the reliability of the open-hole packers that are installed to form isolated compartments defined by the production tubing and the surrounding reservoir rock wall that is the well bore. The purpose of installing the open-hole packers is to isolate the section of the production tubing that is perforated to receive the inflow of produced oil from the intervening spaces through which the remainder of the "blank" or imperforated tubing passes. As used herein, the term blank tubing means production tubing that is not perforated and does not constitute an inflow control device (ICD) for admitting hydrocarbon fluids into the tubing for production to the earth's surface.

The surface of the rock in the well bore can be irregular, even in carbonate formations. Such irregularities can interfere with the ability to form a reliable fluid-tight seal using the open-hole packer. At present, there is no method for confirming at the surface that the open-hole packers are completely sealing off the compartments as intended and that the objectives of the advance well completion have been achieved. What is required is a method for directly measuring the reliability of the open-hole packers to create the compartments in advance well completions. This determination is particularly important from the standpoint of well management, and because of the high cost of installing the open-hole packers.

The use of various types of tracers and tracer compositions in conjunction with well completions is known in the art. Several of the patents discussed below utilize tracers to identify the source of fluids produced from the reservoir and to identify specific locations or zones along the bore hole where the fluid(s) entered the bore hole.

One limited solution to the problem of identifying the general area that is the source of produced water has been to coat the interior of at least a portion of the pipe in the toe section of the horizontal tubing with a water-soluble phosphorescent composition. Water entering that compartment will solubilize the tracer. If tests of water produced with the oil at the surface show presence of the tracer compound, it will be known that at least the toe compartment was producing water. In the event of a failure of the packer adjacent the ICD, water containing the tracer will infiltrate the producing compartment and be produced with oil at the surface. Thus, the surface test will be inconclusive as to the actual location(s) of the water incursion(s).

The use of one or more tracer compositions applied to adjacent sections of tubing in a well completion is known. In U.S. Pat. No. 5,892,147, a method of dividing production tubing passing through a casing into a number of zones by packers positioned in the casing, and deploying a readily distinguishable tracer composition by means of explosive charges detonated in conjunction with a perforator gun is described. The amount and type of tracer composition detected with the produced oil and/or gas is utilized to estimate the flow rate through perforations in the various segregated zones.

A method for monitoring hydrocarbon and water production from different production zones/sections in a reservoir and/or injection wells is disclosed in U.S. Pat. No. 6,645,769. The method is said to be useful for differentiating between production of formation and/or injection water from various zones/sections and specifically for use in a "local alarm system" for water breakthrough. So-called "intelligent tracers" are used to distinguish between produced injection water and formation water from each zone/section. A specific tracer or tracers can be immobilized or placed on, e.g., a casing. The occurrence of a water breakthrough can be detected if the formation or a plug located in the formation releases a detectable tracer when the water or brine passes over the tracer composition and the released component is detected downstream. The principal focus of the patent is the disclosure of a wide variety of chemical, biological, radioactive and other types of tracer compositions and compounds, along with their respective detection methods. There is no specific teaching of a method in which a tracer can be used to indicate a failure of an open-hole packer to form or maintain a fluid-tight compartment adjacent the producing end of the tubing.

A method of determining the presence of undesired passageways that have been formed longitudinally between the bore hole wall and the inside peripheral wall of a casing are described in U.S. Pat. No. 3,848,124. One example of an undesirable passageway can be due to defects in a previous cementing job. Radioisotopes are placed adjacent to the casing at spaced-apart locations within the bore hole and on opposite sides of the production formation. The method appears to be limited to a bore hole in which the casing has been cemented in position by filling the annular space. The detection method seems to be limited to a gamma ray survey by logging the completed well.

The use of gravel packs containing distinctive tracers are described in U.S. Pat. No. 4,008,763 and U.S. Pat. No. 5,392,850. In the '763 patent, the use of one or more gravel packs is intended to prevent the infiltration of solids into the production stream and the presence of a tracer at the surface can be analyzed to determine which pack is leaking and requires reworking. The '850 patent includes the addition of a sub that can be actuated based upon tracer samples analyzed at the surface to release a permeability-reducing material into a gravel pack to restore its original functioning.

It will be understood that the pressures and temperatures to which the open-hole packers are subjected are substantial and that, as previously noted, the surrounding reservoir rock wall of the well bore can be irregular, even when drilled through carbonate formations.

It is therefore an object of the present invention to provide a reliable and inexpensive method and apparatus for determining whether water produced at the surface with the hydrocarbon fluid entered the ICD at the completion end, or other intermediate ICD location, from one or more adjacent compartments due to the failure of the open-hole packer(s) used to form the compartment(s).

SUMMARY OF THE INVENTION

The object and other advantages are achieved by the method and assembly of the present invention which comprehends applying a water-soluble tracer composition and an oil-soluble tracer composition as coatings on at least a portion of the exterior surface of a section of blank production tubing that is positioned between one or more open-hole packers that define a non-flowing compartment that is proximate an inflow control device or devices in a horizontal well section. If the water-soluble tracer is detected at the surface in a produced oil-and-water mixture, it can be concluded that the open-hole packer is leaking water into the adjacent oil-producing section. If the oil-soluble tracer is detected at the surface, it can be concluded that the open-hole packer adjacent an ICD has failed and oil has contacted the coating.

In one embodiment, the method and apparatus of the invention is employed at the completion, or toe end of the bore hole to distinguish between water being co-produced from the hydrocarbon-bearing reservoir stratum and water from a previously penetrated water-bearing stratum. In the case of co-production, the water separated at the surface will be free of any water-soluble tracer composition.

As used in describing the invention, the term "non-flowing compartment" means a section of the horizontal well bore defined by a spaced-apart open-hole packer that does not contain an ICD. The term "flowing compartment" means a section that contains an ICD and includes the toe end of the tubing.

The practice of the invention is not limited to any particular type of tracer composition or carrier. The principal requirement is that the tracer-containing composition can be applied to a length or portion of the production tubing that passes through the well bore to its final position at the completion end of the horizontal bore hole while maintaining its integrity as an exterior coating. The term "marker tubing" will be used herein to define a section of tubing, or a portion of tubing that has been coated with a water-soluble and/or oil soluble tracer compound or composition.

The invention is thus directed to the use of a surface coating containing water-soluble and preferably both water-soluble and oil-soluble tracer compounds that are applied to the exterior surface of a section of pipe or production tubing, i.e., marker tubing, prior to its positioning in the well bore. The water-soluble tracer compound is soluble in produced formation fresh or salt water and/or such water that is pumped into the formation to enhance production. Similarly, the oil-soluble tracer compounds are soluble in hydrocarbon fluids. In completions where multiple compartments are to be monitored, a different and distinguishable tracer compound will be applied to each compartmentalized section of marker tubing.

The purpose of the tracers are to identify the lack of effectiveness of open-hole packers that are used to compartmentalize portions of the production tubing string adjacent the inflow control device(s) (ICDs) in the horizontal well bore. In the event that one or more tracer compounds are detected at the surface in the produced hydrocarbon fluid, it provides an indication that the portions containing the tracer coating have not been completely isolated, or compartmentalized, and water is being passed to the ICD.

The invention broadly comprehends a method of determining the effectiveness of one or more compartmentalization seals in providing a water-tight barrier to isolate a hydrocarbon inflow control device forming the terminus of a section of production tubing in a subterranean open-hole well section of reservoir rock, where the production tubing extends to the earth's surface, and the method includes the steps of:

a. securing a first length of marker tubing to the inflow control device, the outer surface of the marker tubing being coated with water-soluble and oil-soluble tracer-containing compositions, each having a set of known distinguishable characteristics;

b. securing an open-hole packer about the outer surface of said first marker tubing, said packer extending radially outwardly from said outer surface to contact the surrounding reservoir wall to thereby create a first compartment containing the inflow control device and a second compartment further defined by the production packer containing at least the portion of said first marker tubing coated with tracer composition;

c. extracting a hydrocarbon fluid stream from the reservoir rock through the inflow device and the production tubing and producing the hydrocarbon fluid stream at the earth's surface;

d. testing the hydrocarbon stream at the earth's surface for the presence of said tracer composition in order to determine the effectiveness of the compartmentalization of said open-hole well section by the open-hole packer.

In a preferred embodiment, the method of the invention includes the further steps of securing a second open-hole tube packer about the outer surface of the production tubing downstream of the first packer, to thereby create a third compartment containing a second length of tubing in fluid communication with the first length of marker tubing, and applying a marker coating consisting of a different pair of water-soluble and oil-soluble tracer compositions to at least a portion of the outer surface of the second length of tubing that is located within the third compartment.

In a further preferred embodiment one or more additional open-hole packers are installed in spaced apart relation to define a plurality of non-flowing and flowing compartments on which at least a portion of the external surface of the tubing in the non-flowing compartment is coated with a water-soluble and an oil-soluble tracer composition each of which is distinguishable by appropriate testing from oil of the other tracer composition used in the well completion, whereby analysis of the produced fluids sampled at the earth's surface identifies any tracer compositions present and the effectiveness of the compartmentalization of each such non-flowing compartment.

The apparatus of the invention comprehends an assembly disposed in a hydrocarbon fluid producing well in reservoir rock for determining portion of the well at the earth's surface of the well the effectiveness of one or more compartmentalization seals placed in a horizontal open-hole well section, wherein the open-hole well section is defined by a generally cylindrical wall having at least generally horizontal axis, and the assembly includes the following:

a first inflow control device disposed within the open-hole well horizontal section for receiving an inflow of hydrocarbon fluid;

a first length of production tubing coupled to the first inflow control device, wherein at least a portion of the outer surface of the first length of production tubing is coated with a water-soluble tracer-containing composition;

an open tube packer disposed about the outer surface of said first length of tubing and extending radially outwardly to contact the reservoir wall and thereby create a first compartment containing the inflow control device and a second downstream region containing at least the portion of the production tubing coated with tracer;

additional lengths of production tubing coupled to the first length of tubing and extending to the earth's surface; and testing means operably associated with the production tubing at the earth's surface for determining the presence of any tracer composition in the hydrocarbon fluid produced, whereby the effectiveness of the compartmentalization of said open-hole well section by the open-hole packers can be determined.

In a preferred embodiment, the apparatus includes a second section of blank tubing disposed in the open-hole well section and coupled to an opposite end of the inflow control device; and a second open-hole packer disposed about the outer surface of the second length of tubing, where at least a portion of the second length of tubing is coated with water-soluble and oil-soluble tracer-containing compositions that are each different than the tracers on the first length of tubing. In this embodiment, two non-flowing compartments are defined.

In another preferred embodiment, the assembly of the invention includes at least a second inflow control device disposed in the open-hole well section that is coupled to the end of the first length of tubing opposite the first inflow control device and a second open-hole packer is disposed about the outer surface for creating a second compartment containing the second inflow control device, such that the tracer-containing composition is located adjacent the second flowing compartment.

The testing apparatus at the earth's surface includes means for periodically or continuously sampling or contacting the produced hydrocarbon fluid for the presence of the one or more tracer compounds. Sampling devices can be manual and/or automated, and can include probes inserted into the flowing fluid. Such testing devices are commercially available and form no part of the claimed invention.

As noted above, tracer coating compositions are also well known in the art and are commercially available.

BRIEF DESCRIPTION OF THE DRAWINGS

The invention will be further described with reference to the description which follows and the attached drawings in which the same or similar elements are referred to by the same numbers, and where.

DETAILED DESCRIPTION OF THE INVENTION

Figure 1:
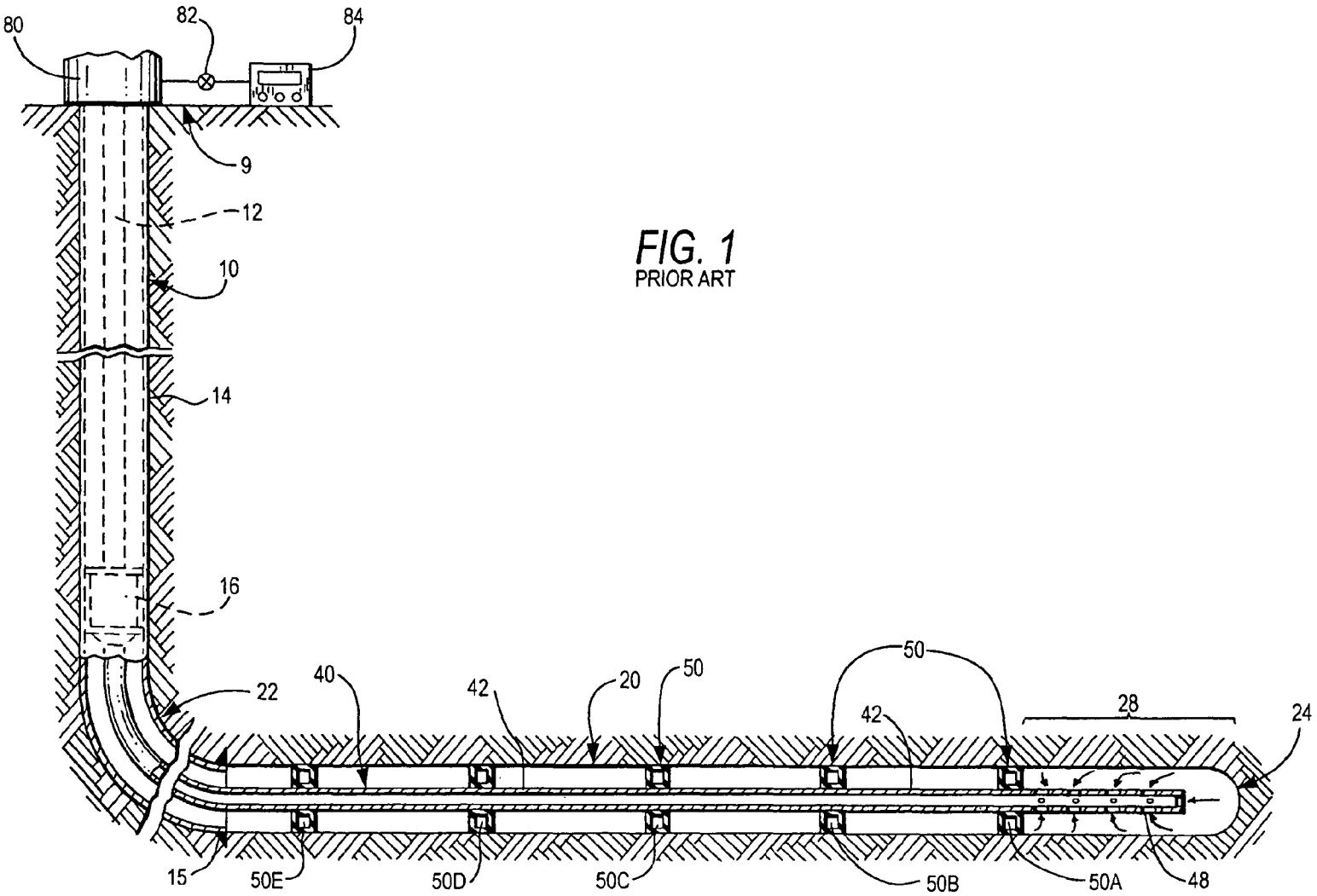
FIG. 1 PRIOR ART
FIG. 1 is a schematic diagram of a typical horizontal wellbore completion of the prior art utilizing a plurality of open-hole packers.

Referring to FIG. 1, a well completion in accordance with the prior art is illustrated that includes a vertical well bore section 10 extending from the earth's surface 9 and containing production tubing 12 and casing 14, with a production packer 16 that seals the annulus between the casing and tubing. It will be understood by one of ordinary skill in the art that the length of the vertical section 10 can be many thousands of feet. The horizontal section 20 of the open well bore is also of indeterminate length and is defined by the curved transitional heel portion 22 and the completion end, or toe, 24. Note that the casing 14 terminates at region 15 which defines the beginning of the open hole portion of the well. In the illustration of FIG. 1, the horizontal length of tubing is identified as element 40 and is fitted with a single ICD 48 in the toe 24 of the open bore hole.

Also shown in FIG. 1 is sampling point 80 located at the earth's surface that includes control valve 82 and suitable sampling, testing, recording and alarm apparatus 84. The use of five (5) open-hole packers, identified generally as 50, are shown secured to horizontal production tubing 40 in accordance with methods and procedures known in the prior art. As noted above, the term "open-hole" refers to the fact that well casing 14 terminates at 15 and no well casing pipe 14 is installed in the horizontal section, as it is in the vertical portion of the well bore. In order to isolate the compartments between the packers, a fluid-tight seal with the rock surface must be formed. A section of tubing containing an ICD is referred to as a flowing compartment and a section containing blank or unperforated tubing as a non-flowing compartment.

As will be understood from the illustration of FIG. 1, the failure of any one of the open-hole packers will result in the passage of any reservoir fluids present in a non-flowing compartment into the compartment adjacent to the failed open-hole packer. In the prior art system illustrated by FIG. 1, the detection of reservoir water with hydrocarbons sampled at the surface sampling point 80 can be an indication that water is being drawn into the ICD directly from the reservoir with the hydrocarbons or that it is leaking into the flowing compartment from what was intended to be a non-flowing compartment. As noted in the discussion of the prior art, it is known to place a water-soluble tracer on the tubing in the toe end, but even that method is indefinite where the first open-hole packer 50A has failed and water is entering from the non-flowing compartment defined by packers 50A and 50B.

Figure 2:
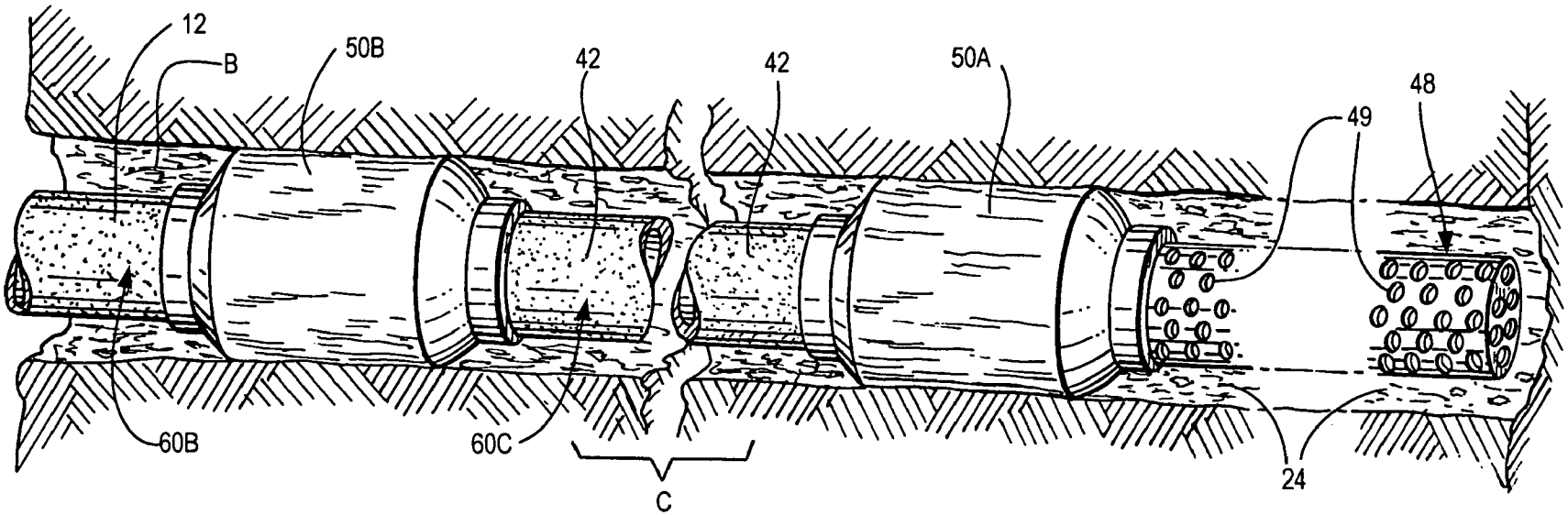
FIG. 2 is a schematic diagram of a portion of a completion similar to FIG. 1 which includes multiple compartments and tubing sections coated with different water-soluble and oil-soluble tracers in accordance with the present invention.

The same procedures are followed to determine the seal effectiveness of one or more of the compartments in the advance well completion of FIG. 2 in the event that one or more tracers are found by testing of the produced hydrocarbons and water at surface.

Referring now to FIG. 2, a pair of open-hole packers 50 are shown illustratively flanking a short section of blank production tubing, or pipe, 42 which is attached at one end to the inflow control device 48, which is typically a section of perforated tubing for admitting hydrocarbon fluids. The downstream end of tubing section 42 is joined to the remainder of the production tubing 12, which extends to the earth's surface at 9. In actual practice, the length of the blank pipe could be hundreds of feet in length, and would be assembled from a number of shorter sections joined by couplings (not shown).

The method of the present invention can be utilized to reliably determine whether the packers are functioning as intended to isolate an ICD from flanking spaces through which pass sections of blank pipe. For example, if packer 50A in FIG. 2 is providing an incomplete seal, water present in the non-flowing annular space "C" formed between packers 50A and 50B will infiltrate the production zone 24 and be produced to the surface with the inflowing oil.

However, in accordance with the invention, the water-soluble coating 60C on section 42 passes into zone 24 and enters the ICD 48 and eventually is detected at the sampling point 80 at the earth's surface. Since it is also common for water to be co-produced from the reservoir rock with the oil due to other local conditions, water produced at the surface that does not contain the tracer compound can be confirmed as co-produced water. It is important for the reservoir production manager to know whether water observed in tests of the produced fluids at the surface sampling pant 80 is entering the production zone 24 with the oil from the adjacent reservoir rock or from an adjacent non-flowing compartment. If the water is leaking from an adjacent compartment, steps can be taken to rectify the situation and reduce the flow of water.

In a further embodiment of the method and system, a plurality of water-soluble and oil-soluble tracer compositions, e.g., 60A, 60B, etc., exhibiting distinctive characteristics can be applied to different compartmentalized sections of tubing 42, and their respective locations maintained in a well log. In this way, the presence of one or more of the distinctive tracer compounds can be associated with one or more corresponding compartments. If produced water contains a tracer applied to the exterior surface of tubing or piping in a compartment that is remote from the ICD 48, it can be concluded that one or more of the intermediate open-hole packers has failed.

For convenience, and the purposes of illustration, the water-soluble and oil-soluble coatings are shown in uniform stippling in the drawings. It will be understood that the coating compositions can be applied as separate bands or sections and cured as required by their respective properties.

This aspect of the method can also include applying tracer-containing coatings to the exterior of the production sections between any of the plurality of open-hole packers so that any water or oil produced from the reservoir with the oil will solubilize and carry along its own distinctive tracer composition.

Figure 3:
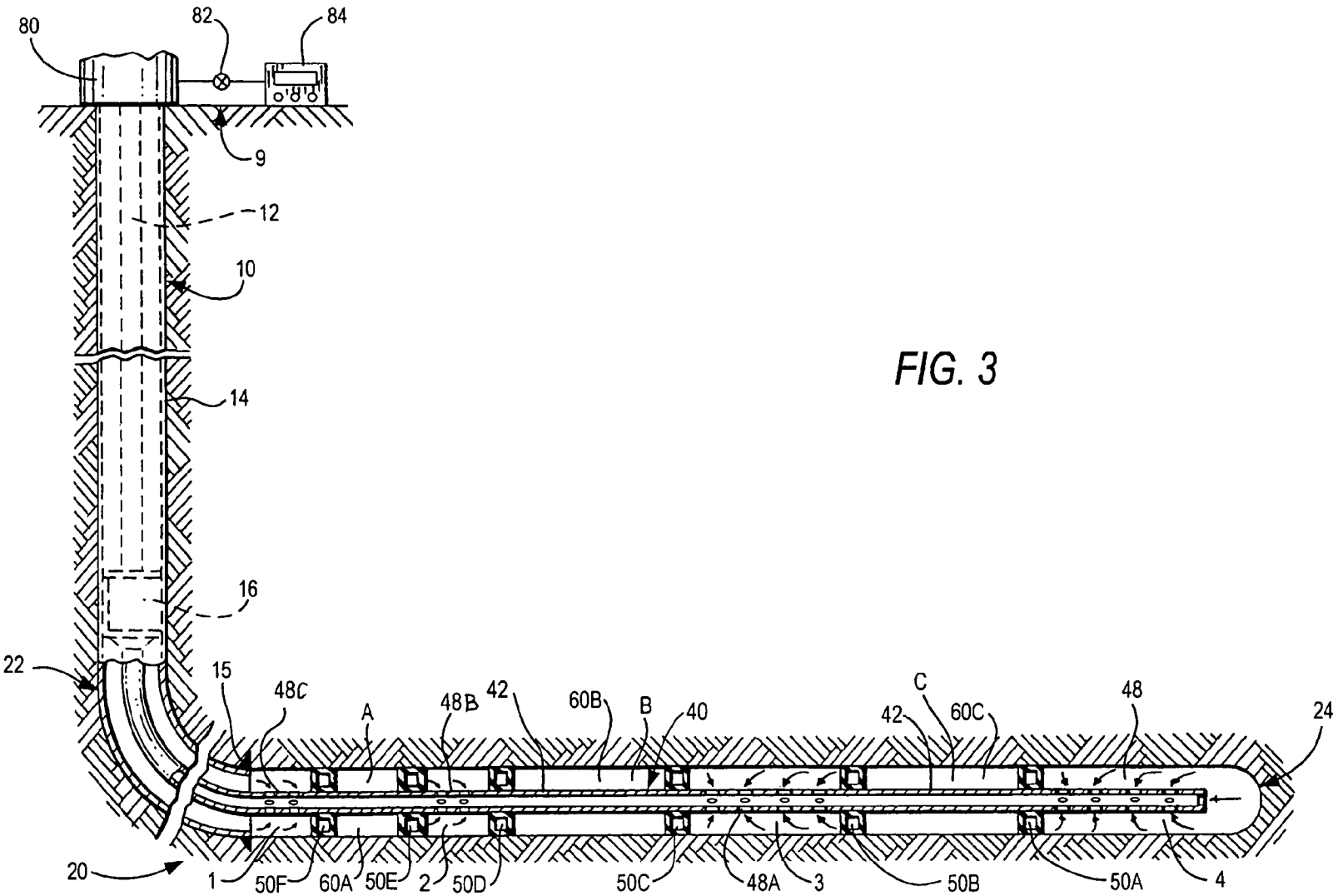
FIG. 3 is a schematic diagram of a horizontal well bore completion with multiple ICDs and intermediate compartments showing the application of water-soluble and oil-soluble external tracer coatings in accordance with the invention.

Referring now to FIG. 3, there is schematically illustrated another preferred embodiment of the invention in which additional ICDs 48 are positioned along the horizontal tubing string 40 in a series of spaced-apart hydrocarbon production zones. These input control devices 48 are isolated by open-hole packers 50A, 50B, 50C, 50D, 50E and the production packer 16, thereby forming production flowing compartments 1, 2, 3 and 4. This configuration of completion is used where the horizontal well bore 20 passes through one or more additional hydrocarbon-producing zones that correspond generally to the flowing compartments. These additional production zones can be located some distance from the toe end 24 of the horizontal well bore where ICD 48 is located. The surfaces of tubing sections 42 in non-flowing compartments adjacent to the flowing compartments are coated with water-soluble and oil-soluble marker compositions, each of which have distinctive and distinguishable characteristics that can be individually identified at the surface test station 84.

With continuing reference to the advance well completion of FIG. 3, the method of determining the seal effectiveness of one or more compartments in accordance with the method of the invention will be described. The method includes the steps of coating the exterior surface of the tubing in the non-flowing compartment A with water-soluble and oil-soluble tracers 60A; coating the exterior surface of the tubing in the non-flowing compartment B with water-soluble and oil-soluble tracers 60B; coating the exterior surface of the tubing in the non-flowing compartment C with water-soluble and oil-soluble tracers 60C, where tracers A, tracers B and tracers C are, respectively, three different water-soluble and oil-soluble tracers that can be readily be recognized and distinguished separately when produced at surface and subjected to testing of the type known to the art.

Assuming that the open-hole packer 50A fails and 50B is holding, tracers 60C will be produced with the reservoir fluids entering the flowing compartment 4. Tracers 60C will be detected with the produced reservoir fluids at surface. As a result, it will be revealed that the non-flowing compartment C is not functioning. In this case, the flowing compartment 4 and the non-flowing compartment C are considered as one compartment. However, the effect of the open-hole packer 50B will be negligible without the sealing of 50A. Therefore, flowing compartment 4, non-flowing compartment C and the flowing compartment 3 are considered as one compartment.

Assuming that the open-hole packer 50B fails and 50A is holding, tracers 60C will be produced with the reservoir fluids entering the flowing compartment 3. Tracers 60C will be detected with the produced reservoir fluids at surface. As a result, it will be determined by the test results of 84 that the non-flowing compartment C is not functioning. In this case, the flowing compartment 3 and the non-flowing compartment C are considered as one compartment. However, the effect of the open-hole packer 50A will be negligible without the sealing of 50B. Therefore, flowing compartment 4, non-flowing compartment C and the flowing compartment 3 are considered as one compartment.

The sampling station can also utilize appropriate software to accept predetermined minimum levels of tracer compounds, which corresponds to a determinable percent of water based on the flowrate of hydrocarbon fluid and water, without sounding an alarm. Thus, some predetermined volume of leakage of ground water will be tolerated, but when the detected concentration or level of the tracer compound(s) exceeds a predetermined value, the alarm is generated.

Figure 4:
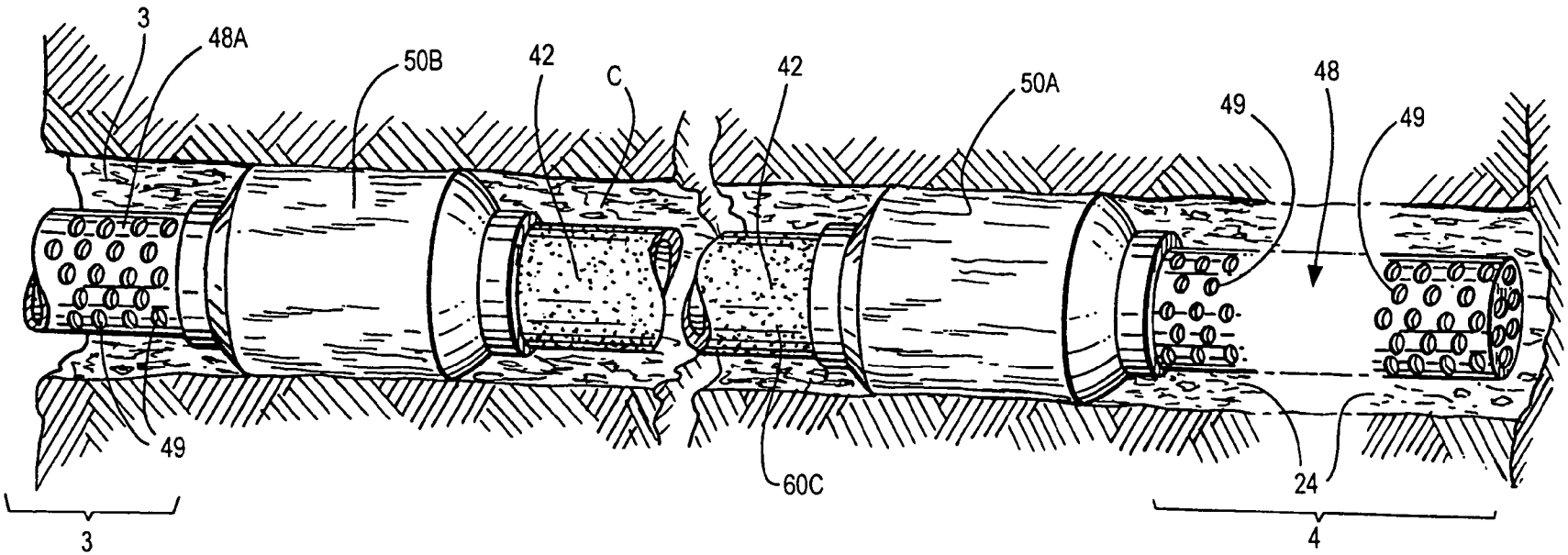
FIG. 4 is an enlarged view of a portion of the completion shown in FIG. 3.

In a further detailed illustration of the method and apparatus of the invention, and with reference to FIG. 4, the condition arises where packers 50B and 50A lose their seals and water in compartment C infiltrates toe end compartment 4 and flowing compartment 3. The water and oil solubilizes coating 60C and both are produced the two ICDs 48 to surface sampling station 80 with the hydrocarbon fluid. Referring to the well logs, the production manager readily determines the location and identification of the failed open-hole packers as 50B and 50A.

Similarly, if tracer compounds 60A and 60B were detected by the sampling station 84, it would be concluded that packers 50C, 50D, 50E and/or 50F had failed. The relative concentration of the two tracers can also be determined and used as a basis for estimating the relative volume of water entering from each compartment. As was explained above, water co-produced from the reservoir rock through ICD 48 with the hydrocarbon fluid(s) will not contain a tracer compound.

Similarly, if oil were to pass from a flowing compartment into an adjacent or more remote non-flowing compartment, the oil-soluble tracer(s) would be dissolved and be produced with the hydrocarbons at the surface. Since the location of each oil-soluble composition is known to the production manager, the location of the failed open-hole packers can also be identified. This type of operational information and control is not possible with the methods and assemblies of the prior art.

From the above description, it will be understood that the present invention broadly comprehends the use of a tracer material to indicate whether one or more open-hole packers positioned in a horizontal oil well bore are functioning properly to isolate an adjacent production section fitted with an ICD by applying a coating containing a water-soluble composition to the exterior surfaces of the tubing.

The invention has been described in detail above and illustrated in the attached drawings. Other embodiments and modifications will be apparent to those of ordinary skill in the art and the scope of the invention is to be determined by the claims that follow.

What is claimed is:

1. A method of determining the effectiveness of one or more compartmentalization seals in providing a water-tight barrier to isolate a hydrocarbon inflow control device forming the terminus of a section of production tubing that is positioned in the toe end of a subterranean open-hole well section of reservoir rock, the production tubing extending to the earth's surface, the method comprising:

a. securing a first length of marker tubing to the inflow control device, the outer surface of the marker tubing being coated with water-soluble and oil-soluble tracer compositions, each having a first set of known characteristics;

b. securing a first open-hole packer about the outer surface of said first marker tubing, said packer extending radially outwardly from said outer surface to contact the surrounding reservoir wall to thereby create a first flowing compartment containing said inflow control device at the toe end of the well and a second non-flowing compartment containing the portion of said first marker tubing coated with tracer compositions;

c. extracting a hydrocarbon fluid stream from the reservoir rock through the inflow device and the production tubing and producing the hydrocarbon fluid stream at the earth's surface; and d. testing the hydrocarbon stream at the earth's surface for the presence of said tracer compositions in order to determine the effectiveness of the compartmentalization of said open-hole well section by the open-hole packer.

2. The method according to claim 1, wherein the inflow control device comprises a perforated pipe.

3. The method according to claim 1, which further comprises:

securing a second open-hole packer about the outer surface of the production tubing downstream of the first packer, to thereby create a third compartment containing a second length of tubing in fluid communication with the first length of marker tubing.

4. The method according to claim 3, further comprising the step of applying a marker coating consisting of water-soluble tracer composition to a portion of the outer surface of said second length of tubing which is located within the non-flowing third compartment.

5. The method according to claim 4, further comprising the step of coating at least a portion of said second section which is to be located within said third compartment with a water-soluble tracer having a composition that is different from the water-soluble tracer on the outer surface of said first length of marker tubing.

6. The method according to claim 1, wherein the first length of marker tubing has first and second ends, and wherein said first inflow control device is coupled to said first end, further comprising the steps of:

coupling a second inflow control device to said second end, said second inflow control device being located within said open-hole well section; and securing a second open-hole packer on the tubing to create a second flowing compartment containing said second inflow control device, wherein said second open-hole packer is positioned so that said tracer composition is located in said second flowing compartment.

7. The method according to claim 6, wherein said first inflow control device has first and second ends, and wherein said first length of tubing is coupled to the first end of said first inflow control device, further comprising the steps of:

coupling a second length of tubing to the second end of said first inflow control device, said second length of tubing being located within said open-hole well section and having an outer surface; and securing a third open-hole packer to the outer surface of said second section to thereby create a non-flowing third compartment containing said second length of tubing.

8. The method according to claim 7, further comprising the step of coating a least a portion of said second length of tubing which is located in said non-flowing third compartment with a water-soluble tracer composition.

9. The method according to claim 7, further comprising the step of coating a least a portion of said second length of tubing which is located within said third compartment with a water-soluble tracer composition which has characteristics that are detectably different from the water-soluble tracer composition on the outer surface of said first length of tubing.

10. An assembly disposed in a hydrocarbon fluid producing well containing an open-hole well section formed in reservoir rock configured for determining, at the earth's surface, the effectiveness of one or more compartmentalization seals placed in the open-hole well section, wherein the open-hole well section is defined by a generally cylindrical wall having an at least generally horizontal axis, said assembly comprising:

a first inflow control device disposed within the toe end of said open-hole well section for receiving an inflow of hydrocarbon fluid;

a first length of production tubing coupled to said first inflow control device, wherein at least a portion of the outer surface of the first length of production tubing is coated with water-soluble and oil-soluble tracer compositions;

an open-hole packer disposed about the outer surface of said first length of tubing, said packer extending radially outwardly from said outer surface to contact said reservoir wall to thereby create a first flowing compartment at the toe end of the well containing said inflow control device and a non-flowing second downstream region containing at least the portion of said blank tubing coated with said tracer;

additional lengths of production tubing coupled to the first length of tubing and extending to the earth's surface; and testing means in association with the producing tubing at the earth's surface for determining the presence of any tracer composition in the hydrocarbon fluid produced, whereby the effectiveness of the compartmentalization of said open-hole well section by the open-hole packer can be determined.

11. The assembly according to claim 10, wherein said inflow control device comprises a perforated pipe.

12. The assembly according to claim 10, wherein said first length of production tubing has first and second ends, and wherein said first inflow control device is coupled to said first end, and further comprising:

a second section of blank tubing disposed in said open-hole well section and coupled to said second end; and a second open-hole packer disposed about the outer surface of said second length of tubing to thereby create a non-flowing second compartment containing said second length of tubing.

13. The assembly according to claim 12, wherein at least a portion of said second length of tubing located in said second compartment is coated with water-soluble an oil-soluble tracer compositions.

14. The assembly according to claim 12, wherein at least a portion of said second length of tubing located in said second non-flowing compartment is coated with water-soluble and oil-soluble tracer compositions that are different from the water-soluble and oil-soluble tracer compositions on the outer surface of said first non-flowing length of tubing.

15. The assembly according to claim 10, further comprising:

a second inflow control device disposed in said open-hole well section and coupled to the end of the first length of tubing opposite the first inflow control device; and a second open-hole packer disposed about said outer surface for creating a second flowing ICD compartment containing said second inflow control device, wherein said second open-hole packer is positioned such that said tracer composition is located in a compartment adjacent said second compartment.

16. The assembly according to claim 15, further comprising:

a second length of tubing disposed in said open-hole well section in fluid communication with the first length of tubing, the outer surface of said second length of tubing being coated with water-soluble and oil-soluble tracer compositions; and a second open tube packer disposed about the outer surface of said second section for creating a third non-flowing compartment containing said second length of tubing coated with said tracer compositions.

17. The assembly according to claim 16, wherein said first and second lengths of tubing are coated with analytically distinguishable different tracer compositions.

18. An assembly disposed in a hydrocarbon fluid producing well containing an open-hole well section formed in reservoir rock configured for determining, at the earth's surface, the effectiveness of one or more compartmentalization seals placed in the open-hole well section, wherein the open-hole well section is defined by a generally cylindrical wall having an at least generally horizontal axis, said assembly comprising:

a plurality of inflow control devices disposed within said open-hole well section at predetermined spaced apart locations, the inflow control devices being joined in fluid communication by sections of blank production tubing, the production tubing extending from the last downstream inflow control device to the earth's surface for delivering fluids produced in the open-hole well section, a plurality of open-hole packers operatively secured to the tubing proximate the inflow control devices to define flowing compartments containing the inflow control devices and intermediate non-flowing compartments containing blank tubing, the tubing in each of the non-flowing compartments being coated with water-soluble and oil-soluble tracer compositions, the respective tracer compositions in each of non-flowing compartment being analytically distinguishable under appropriate test conditions from the tracer compositions in the other non-flowing compartments.

* * * * *